US006327715B1

(12) United States Patent
Castiglione

(10) Patent No.: US 6,327,715 B1
(45) Date of Patent: Dec. 11, 2001

(54) BUTTOCKS PAD

(76) Inventor: Thomas Castiglione, 10173 Burnett Rd., Charlevoix, MI (US) 49720

( * ) Notice: Subject to any disclaimer, the term of this patent is extended or adjusted under 35 U.S.C. 154(b) by 0 days.

(21) Appl. No.: 09/157,141

(22) Filed: Sep. 18, 1998

(51) Int. Cl.[7] ..... A41D 13/00
(52) U.S. Cl. ..... 2/267; 2/227; 2/23
(58) Field of Search ..... 2/455, 267, 467, 2/44, 45, 92, 69, 227, 400, 403, 23; 128/96.1, 99.1; 602/70–71; 450/98, 99

(56) References Cited

U.S. PATENT DOCUMENTS

| | | | | |
|---|---|---|---|---|
| 1,044,494 | | 11/1912 | Clarke . | |
| 1,468,072 | * | 4/1923 | Ogle | 2/23 |
| 1,561,712 | | 11/1925 | Goldsmith . | |
| 1,598,133 | | 8/1926 | Hanson . | |
| 2,637,032 | | 5/1953 | Pinsuti . | |
| 4,807,301 | | 2/1989 | Ferber . | |
| 5,265,277 | | 11/1993 | Hare . | |
| 5,471,680 | * | 12/1995 | Vesterien | 2/467 |
| 5,551,091 | * | 9/1996 | Tyndall | 2/227 |
| 5,727,260 | * | 3/1998 | Torch et al. | 2/455 |

FOREIGN PATENT DOCUMENTS 2043463 3/1971 (DE) .

* cited by examiner

*Primary Examiner*—Gloria M. Hale
*Assistant Examiner*—Tejash Patel
(74) *Attorney, Agent, or Firm*—Stephen R. Greiner

(57) ABSTRACT

A pad adapted to keep the buttocks of a user warm and dry when sitting on snow covered surfaces and the like. The pad includes an insulative layer formed of closed-cell foam. The insulative layer is substantially rectangular in outline and has an upper edge, a lower edge, and a pair of side edges. The lower edge has a slot at the midpoint thereof extending toward the upper edge. A protective layer covers one side of the insulative layer. At least one buttonhole penetrates the protective layer and the insulative layer adjacent the upper edge thereof. The buttonhole permits the pad to be suspended by a button from the waistband of trousers.

9 Claims, 1 Drawing Sheet

BUTTOCKS PAD

FIELD OF THE INVENTION

The present invention relates generally to articles of apparel and, in particular, to trouser-attached guards and protectors.

BACKGROUND OF THE INVENTION

Skiers, snowmobilers, campers and others spending time outdoors in the winter must often sit on snow-covered surfaces. Not only does the cold penetrate through the compressed seats of their trousers, but melted snow sometimes does as well to great annoyance. Attempts to overcome this problem with insulated and waterproofed garments have not been entirely successful since these garments have tended to be bulky and expensive. A need, therefore, exists for an unobtrusive and inexpensive product that will permit a user to sit upon cold and wet surfaces yet remain warm and dry.

SUMMARY OF THE INVENTION

In light of the problems associated with the prior art cold weather garments, it is a principal object of the invention to provide a pad of such dimensions that it can be worn unobtrusively within any pair of trousers and keep the buttocks of a user warm and dry when sitting upon snow or other cold, wet surfaces.

It is another object of the invention to provide a pad of the type described which is capable of adjusting to changes in body position when worn and is comfortable to wear for extended periods.

It is a further object of the invention to provide a pad of the type described which is easily positioned within and removed from trousers.

It is an object of the invention to provide improved elements and arrangements thereof in a buttocks pad for the purposes described which is lightweight in construction, inexpensive in manufacture, and dependable in use.

Briefly, the buttocks pad in accordance with this invention achieves the intended objects by featuring an insulative layer formed of closed-cell foam. The insulative layer is substantially rectangular in outline and has an upper edge, a lower edge, and a pair of side edges. The lower edge has a slot at its midpoint extending toward the upper edge. A protective layer covers one side of the insulative layer. At least one buttonhole penetrates the protective layer and the insulative layer adjacent the upper edge thereof. The buttonhole permits the pad to be suspended by a button from trousers.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
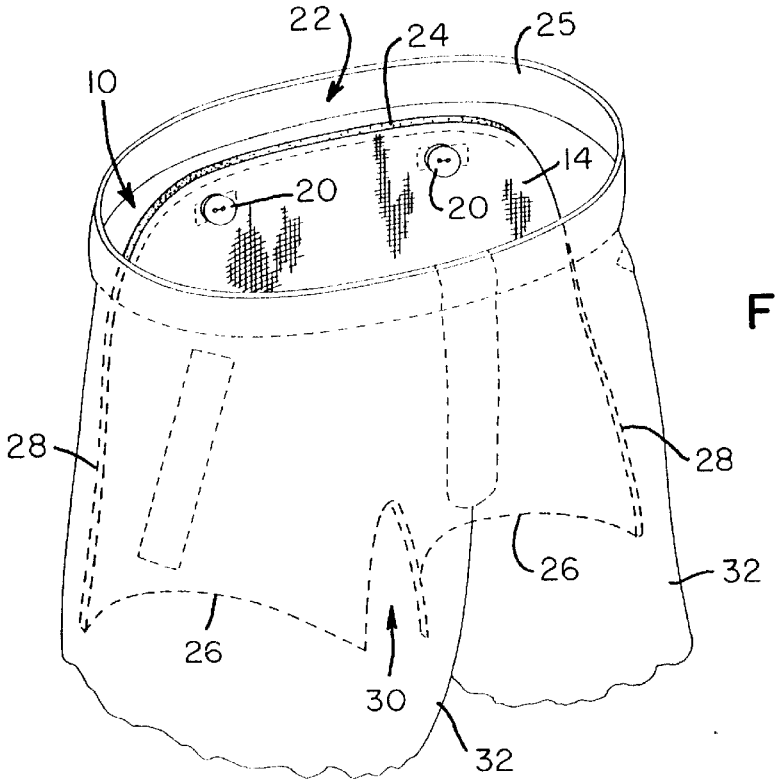
FIG. 1 is a perspective view of a buttocks pad in accordance with the present invention secured within trousers.
Figure 3:
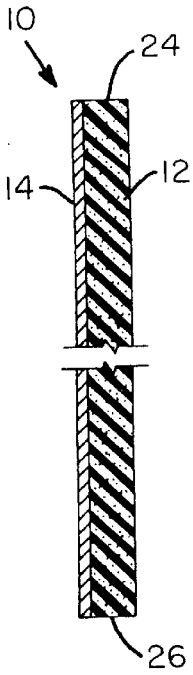
FIG. 3 is a cross-sectional view taken along line 3—3 of FIG. 2.
Figure 2:
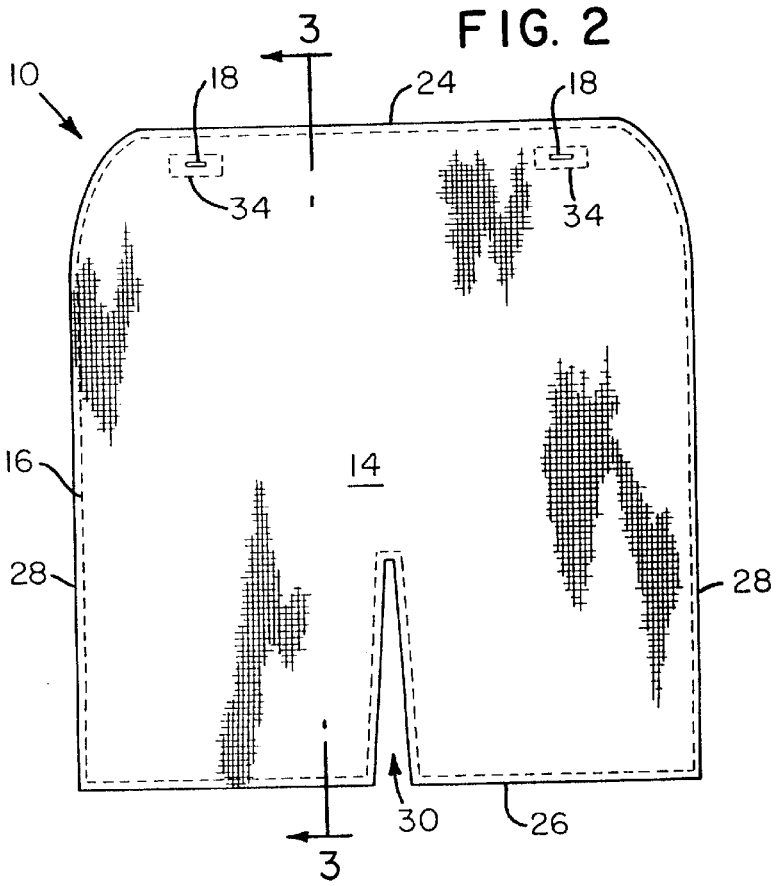
FIG. 2 is a front elevational view of the buttocks pad of FIG. 1.

Referring now to the FIGS., a buttocks pad in accordance with the present invention is shown at 10. The pad 10 includes an insulative layer 12 made of a closed-cell foam material such as neoprene. A protective layer 14 of woven "ripstop" nylon fabric is secured by adhesive cement (not shown) and peripheral stitching 16 to one side of the insulative layer 12. Buttonholes 18, penetrating the insulative and protective layers 12 and 14, permit the pad 10 to be suspended by buttons 20 adjacent the waistband 25 of trousers 22.

The pad 10 is contoured to fit unobtrusively within the seat of the trousers 22. As shown, the pad 10 has an upper edge 24, a lower edge 26, and a pair of side edges 28, all arranged in a generally rectangular configuration. The side edges 28 are preferably curved to reduce the length of the upper edge 24 so as to better fit near the waistband 25. A V-shaped slot 30 is provided in the middle of the lower edge 26 to receive the crotch of the trousers 22 and permit the pad 10 to conform to the movements of the trouser legs 32. The slot 30 extends about ⅓ of the way from the lower edge 26 to the upper edge 24.

The buttonholes 18 are provided adjacent the upper edge 24 of the pad 10. Each of the buttonholes 18 is about 0.5 inches (1.3 cm) long. Preferably, each of the buttonholes 18 is reinforced by outline stitching 34 as shown in the FIGS.

Although small in size, the pad 10 substantially reduces the loss of heat from a user to a cold or wet surface. In the preferred embodiment, the pad 10 is approximately 0.125 inches (0.318 cm) thick. The preferred width of the pad 10 is about 15.5 inches (39.4 cm) and the preferred length is about 16.3 inches (41.3 cm).

The initial installation of the pad 10 in the trousers 22 is straightforward. First, a user positions the pad 10 at a desired location within the trousers 22. Then, the tip of a marker (not shown) is pushed through each of the buttonholes 18 to mark the locations where the buttons 20 are to be sewn. After removing the pad 10 from the trousers 22, the buttons 20 are sewn to the trousers 22 in the marked locations. By later pushing the buttons 20 through the buttonholes 18, the pad 10 is unobtrusively and releasably secured in the trousers 22. After the pad 10 is installed in the trousers 22, the trousers may be worn in the usual manner.

From the foregoing, it should be appreciated that the pad 10 is easy to insert and remove from the trousers 22. During wear, the insulative layer 12 keeps a user exceptionally warm and dry. The protective layer 14, being formed of a durable yet soft-to-the-touch material, prolongs the life of the insulative layer 12 by reducing wear and enhances user comfort.

While the invention has been described with a high degree of particularity, it will be appreciated by those skilled in the art that modifications may be made thereto. For example, the outline of the pad as well as the number and location of the buttonholes can be tailored to suit any trousers. Therefore, it is to be understood that the present invention is not limited to the sole embodiment described above, but encompasses any and all embodiments within the scope of the following claims.

I claim:

1. A buttocks pad, comprising:

an insulative layer formed of neoprene sheeting, said insulative layer being substantially rectangular in outline and having an upper edge, a lower edge, and a pair of side edges therebetween, said lower edge having a slot at the midpoint thereof extending about one third of the distance toward said upper edge;

a protective layer formed of woven nylon fabric covering one side of said insulative layer, said protective layer being attached to said insulative layer by adhesive cement and peripheral stitching; and, a pair of buttonholes penetrating said protective layer and said insulative layer adjacent said upper edge, each of said buttonholes being reinforced by outline stitching.

2. A buttocks pad for positioning in trousers having a waistband, a pair of legs extending from the waistband, and a crotch at the junction of the legs, said buttocks pad comprising an insulative layer formed of closed-cell foam, said insulative layer being substantially rectangular in outline and having an upper edge for positioning adjacent the waistband of the trousers, a lower edge for positioning within the legs of the trousers, and a pair of side edges therebetween, said lower edge having a slot at the midpoint thereof extending toward said upper edge for receiving the crotch of the trousers.

3. The buttocks pad according to claim 2, wherein said insulative layer has at least one buttonhole adjacent said upper edge thereof.

4. The buttocks pad according to claim 1, wherein said insulative layer is formed of neoprene.

5. The buttocks pad according to claim 2 wherein said insulative layer is covered on one side thereof by a protective layer.

6. The buttocks pad according to claim 5 wherein said protective layer is woven nylon fabric.

7. A buttocks pad, comprising:

an insulative layer formed of closed-cell foam, said insulative layer being substantially rectangular in outline and having an upper edge, a lower edge, and a pair of side edges therebetween, said lower edge having a slot at the midpoint thereof extending toward said upper edge;

a protective layer covering one side of said insulative layer; and, at least one buttonhole penetrating said protective layer and said insulative layer adjacent said upper edge.

8. The buttocks pad according to claim 7 wherein said insulative layer is formed of neoprene.

9. The buttocks pad according to claim 7 wherein said protective layer is woven nylon fabric.

* * * * *